US005819382A

United States Patent [19]

Greif et al.

[11] Patent Number: 5,819,382

[45] Date of Patent: Oct. 13, 1998

[54] TENTER UNIT

[75] Inventors: Steffen Greif, Spitzkunnersdorf; Peter Pfeiffer, Olbersdorf; Ingo Lison, Seifhennersdorf, all of Germany

[73] Assignee: Küsters Zittauer Maschinenfabrik GmbH, Zittau, Germany

[21] Appl. No.: 981,073

[22] PCT Filed: Mar. 9, 1996

[86] PCT No.: PCT/DE96/00462

§ 371 Date: Nov. 25, 1997

§ 102(e) Date: Nov. 25, 1997

[87] PCT Pub. No.: WO96/39554

PCT Pub. Date: Dec. 12, 1996

[30] Foreign Application Priority Data

Jun. 3, 1995 [DE] Germany ..... 195 20 513.8

[51] Int. Cl.[6] ..... D06C 3/06

[52] U.S. Cl. ..... 26/90; 26/91; 26/96

[58] Field of Search ..... 26/90, 91, 96, 26/97, 98, 86, 89

[56] References Cited

U.S. PATENT DOCUMENTS

| | | | |
|---|---|---|---|
| 88,505 | 3/1869 | Palmer | 26/90 |
| 148,082 | 3/1874 | Palmer | 26/90 |
| 4,494,740 | 1/1985 | Noboru et al. | 26/90 |
| 5,042,121 | 8/1991 | Young, Jr. | 26/96 |
| 5,259,097 | 11/1993 | Aihara et al. | 26/90 |
| 5,555,610 | 9/1996 | Young, Jr. et al. | 26/96 |

FOREIGN PATENT DOCUMENTS

| | | | |
|---|---|---|---|
| 480155 | 7/1929 | Germany . | |
| 610937 | 3/1935 | Germany . | |
| 41 41 779A 1 | 6/1993 | Germany . | |
| 245 | of 1857 | United Kingdom | 26/90 |
| WO 94/10369 | 5/1994 | WIPO . | |

*Primary Examiner*—Amy B. Vanatta
*Attorney, Agent, or Firm*—Kenyon & Kenyon

[57] ABSTRACT

A width stretching unit for textile webs includes a first needle disc unit having first and second needle discs disposed along a first axis at a distance corresponding to the width of the web of material and a second needle disc unit having a second axis which is situated in the pivoting plane parallel to the first axis, and having third and forth needle discs arranged perpendicular to the second axis that rotate about the second axis with the same peripheral speed as the first and second needle discs. The axial distance between the third and fourth needle discs is equal to the axial distance between the first and second needle discs in a zone of increased distance between the first and second needle discs. The edges of the first and third needle discs and the edges of the second and fourth needle discs practically touch one another in the zone of increased-distance so that it is possible for the web of material to be transferred from the first and second needle discs to the third and fourth needle discs, respectively, without relinquishing the attachment of the web to the needles on at least one of the first or third needle discs and at least one of the second or fourth needle discs.

29 Claims, 8 Drawing Sheets

Fig. 7
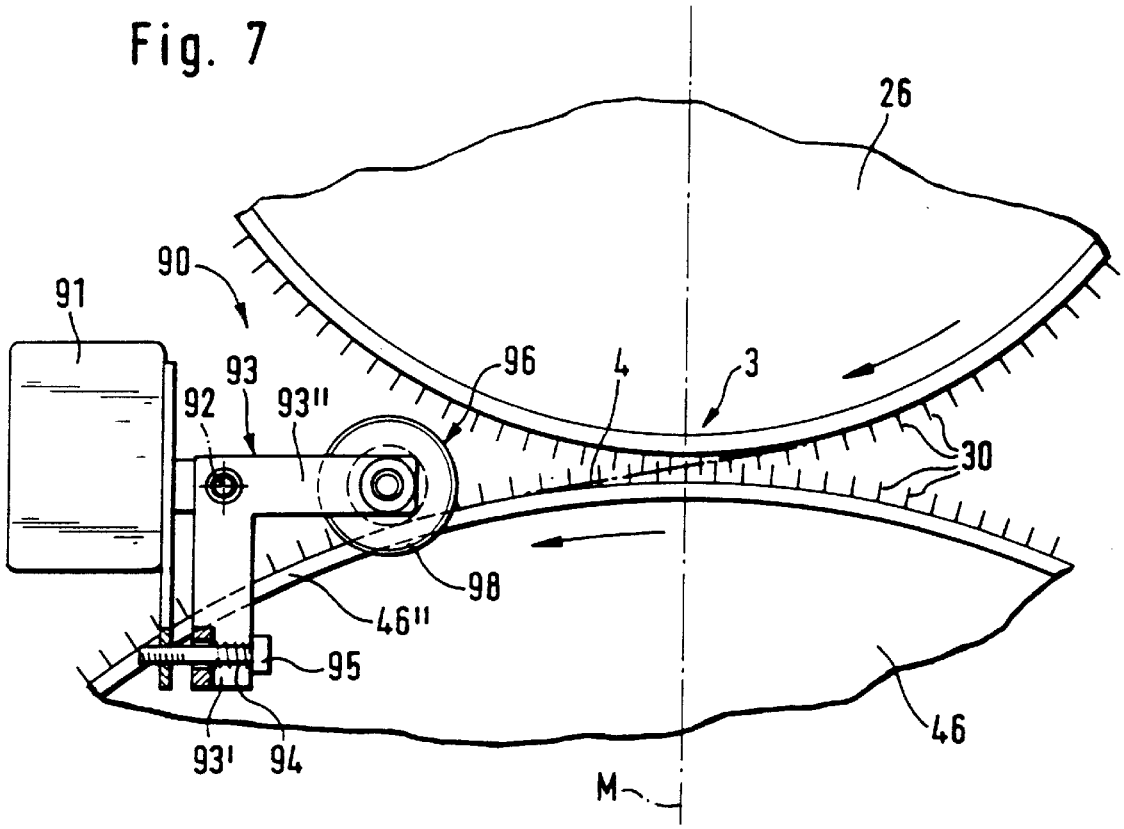
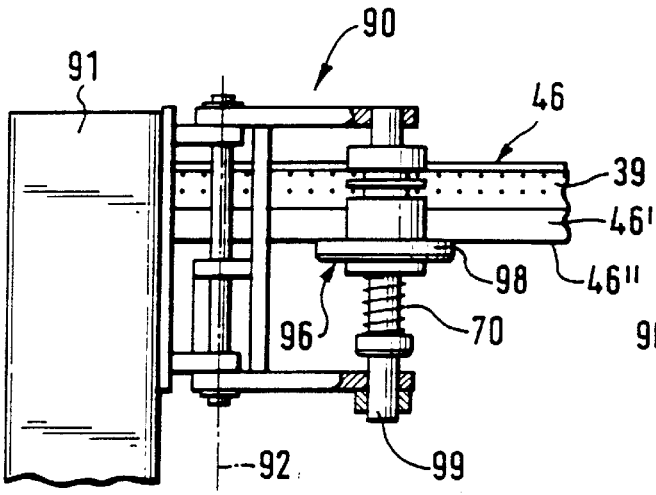
Fig. 8
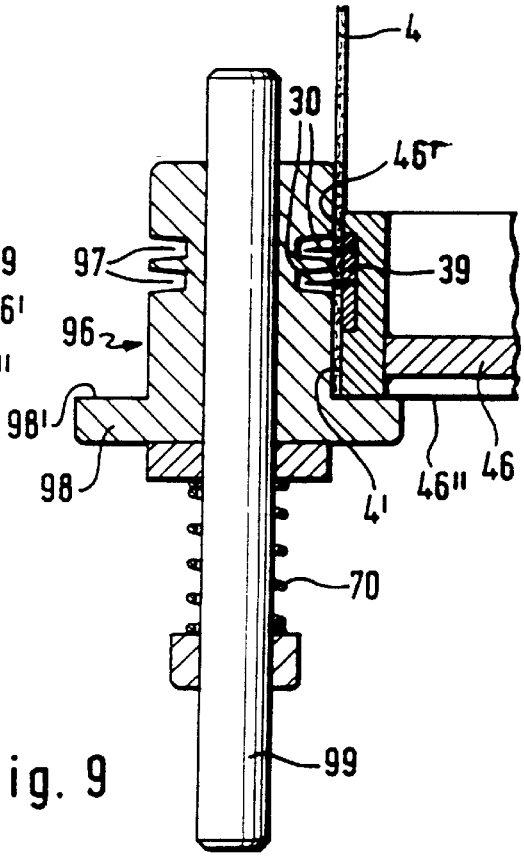
Fig. 9

TENTER UNIT

FIELD OF THE INVENTION

The invention relates to a device for stretching the width of a web of material and more particularly to a width stretching unit having axially spaced needle discs, each of which rotates about an axis that pivots to provide a zone of reduced width between the needle discs and a zone of increased width between the needle discs.

BACKGROUND OF THE INVENTION

The term "needle discs" denotes discs similar to wheels which rotate with the web of material, usually consisting of metal, with their peripheral edges being provided all round with closely set needles of identical lengths. The needle points extend radially outward and penetrate the edges of the web of material to tension the same or keep it tensioned in the direction of the width.

A width stretching unit of this type is known from DE-PS 480 155. A web of material runs onto two obliquely disposed needle discs in the zone where the needle discs have a reduced axial distance between them at their needle edge. The web passes around the needle discs through approximately 240°, the edges of the needle discs moving axially apart so that the web of material engaged by the needles at the selvedges is stretched width-wise. The web leaves the needle discs in a plane offset by an angle of about 90° to the entry plane. The needle discs are adjustable in respect of their angular position and transverse distance and are driven jointly.

DE 41 41 779 Al discloses an apparatus for levelling a web of material, such apparatus also operating with two needle discs, the angular position of which is variable. The purpose of this apparatus is to level a web of material with much less expense than a conventional tentering frame and yet achieve a treatment equivalent to the levelling of a tentering frame.

A common feature of the known devices having relatively pivotable needle discs disposed on a common axis is that the treated web of material is released after it leaves the needle discs. If such apparatus is used in mercerizing and similar plants, the web of material tends to shrink again after width stretching. After leaving the needle discs it immediately contracts in the transverse direction.

OBJECTS AND SUMMARY OF THE INVENTION

An object of the invention is to develop a width stretching unit in which the width stretching effect achieved is maintained positively over a certain travel of the web of material. The width stretching unit is of the type having a first needle disc unit having first and second needle discs disposed along a first axis at an axial distance corresponding to a width of the web of material, the first and second needle discs having a multiplicity of peripherally distributed needles pointing radially outward. The multiplicity of needles are intended for insertion into selvedges of the web of material. The stretching unit also includes a pivoting mechanism for pivoting a first rotational axis and a second rotational axis of the first and second needle discs, respectively, in a pivoting plane passing through the first axis. The stretching unit further includes a pinning mechanism for pinning the web of material by its edges onto the multiplicity of needles of the first and second needle discs in a region of reduced axial distance between edges of the first and second needle discs.

Maintaining the width stretching effect over a certain travel of the web of material is achieved by the present invention which includes a second needle disc unit associated with the first needle disc unit, the second needle disc unit having a second axis parallel to the first axis and situated in the pivoting plane, the second needle disc further having third and fourth needle discs rotatably mounted substantially perpendicular to the second axis, the third and fourth needle discs rotating about the second axis at the same peripheral speed as the first and second needle discs, an axial distance between the third and fourth needle discs being equal to the axial distance between the first and second needle discs in a zone of increased distance between the first and second needle discs, wherein the edge of the first needle disc practically touches the edge of the third needle disc in the zone of increased distance, and the edge of the second needle disc practically touches the edge of the fourth needle disc in the zone of increased distance, so that it is possible for the web of material to be transferred from the first and second needle discs to the third and fourth needle discs, respectively, without relinquishing the pinning on at least one of the first or third needle discs and at least one of the second or fourth needle discs.

Thus, a first needle disc unit has associated therewith a second needle disc unit. The web of material passes from the first needle disc unit to the second needle disc unit at the location on the first needle disc unit of increased width stretching. The web of material is not released during the transfer from the first needle disc unit to the second needle disc unit, and is held fast on the needles in transverse tension over a certain peripheral travel of the second needle disc unit.

One particular application of a width stretching unit of this kind is a mercerizing plant in which the width stretching unit follows the diffusion zone which follows the application of the mercerizing liquor. In this zone the web of material has a strong tendency to shrink transversely and longitudinally and is prevented from so doing by the second needle disc unit.

A palmering disc arrangement, in which the web of material runs over inclined discs at its selvedges and is transversely retained thereon so that it must participate in the increase in the distance as the discs rotate, is the subject matter of DE-PS 610 937. There, the web of material passes to a directly following unit in the form of a calender roller, on which it is held flat in a fixed fabric guide system. However, the transfer is not effected without relinquishing the fixed fabric guide system nor in such manner that the web of material is subsequently engaged only at the edge and held in the transverse direction.

According to the present invention, the degree of width stretching is adjusted by pivoting the two needle discs of the first needle disc unit.

In order automatically to adjust the distance between the needle discs of the second needle disc unit to the new width position, the mounts of the needle discs of the second needle disc unit may be joined to the mounts of the respective needle discs of the first needle disc unit. Thus, when the first needle disc unit is adjusted, the second needle disc unit is thereby simultaneously and automatically adjusted as well.

One advantageous construction and arrangement includes a pivoting drive. The pivoting drive may be a linear actuator mounted axially outside of a pivoting element to which the first and second needle discs are mounted. The linear drive may be mounted such that the linear motion of the drive pivots the pivoting element about a pivot axis, to thereby change the relative planes of rotation of the first and second needle discs.

An important feature is the support drum that may be provided between the needle discs of first needle disc unit and/or between the needle discs of the second needle disc unit. The support drum may substantially fill the axial gap between the needle discs and may have a diameter substantially equal to the diameter of the needle discs. A web of material deflected into a partly cylindrical shape by needle discs engaging the selvedge and subject to transverse tension tends to contract radially, i.e., extend concavely between the needle discs. This can be counteracted by the support drums, which prevent contraction.

Advantageously, the support drum can be adjustable between the needle discs with respect to its length, i.e., the support drum is adjustable in a direction transverse to the web of material, such that the support drum may adjust to the position to which the needle discs have been set. This can be achieved particularly by the construction wherein the support drum may consist of two inter-engaging parts, although it can include more than two appropriately constructed axially inter-engaging parts. For example, the support drum may include at least two coaxial cylindrical parts of the same diameter, the periphery of which consists of freely projecting finger-like segments that have gaps spaced peripherally. The coaxial parts may thus engage one another with corresponding finger-like segments engaging the gaps on the opposing coaxial part. The two parts may further be axially adjusted to thereby adjust the length of the support drum.

One arrangement of the two needle disc units is a superposed arrangement having the first needle disc unit disposed above the second needle disc unit with the web of material being guided onto the top apex of the first needle disc unit. This has a number of advantages. For example, it permits placement of an operator's station positioned to allow observation of the entry of the web of material onto the first needle disc unit. It is also optionally possible to apply a treatment liquid, during and after width stretching, to the web of material extending around the needle disc units, so that the web can be provided with the treatment liquid in its width-stretched position. For example, in the case of mercerization, washing of the mercerizing liquor can be started on the needle disc units, with the result that the web of material loses its tendency to shrink before being released. In this way, the important first phase of stabilization of the web of material to which the liquor has been applied can take place without any risk of loss of width owing to the web of material being prematurely released. Of course the superposition is also advantageous in terms of reduced floor area requirements.

Before the web of material runs onto the first needle disc unit, it may be advantageous to provide selvedge straighteners at both edges to ensure that the web of material passes to the needles in a desirable width position.

Placement of re-needling systems at the selvedges just subsequent to the point of transfer of the web from the first needle disc unit to the second needle disc unit is important in practice. If no special steps are taken, only the longitudinal tension in the web of material is available at the transition from the first needle disc unit to the second needle disc unit to engage the web selvedges on the needles of the second needle disc unit as it runs onto the same. Since the re-needling takes place at a point where there may be considerable transverse tension in the web of material, the engagement of the web of material onto the needles of the second needle disc unit must be effected even under difficult conditions.

To assist this operation and make it more reliable, a re-needling system which presses the edges of the web of material radially from the outside into the needles of the second needle disc unit may be provided.

In one possible embodiment, a re-needling system may include a roller which is provided with peripheral grooves for the passage of the needles and which rolls on the edge of the material or the periphery of the associated needle discs and which presses the web of material down onto the edge of the needle discs next to the needles.

The roller, however, is only one possible construction of a re-needling system of this kind. Revolving brushes, suitably shaped pressure rails, or a nozzle system directing air or a liquid medium radially from outside onto the edge of the web of material in the region of the needles may be used in order to press the edge of the web onto the needles.

According to one embodiment of the invention, the associated roller may be mounted on the support element which also serves to support the first needle disc unit. The purpose of this is that the roller will automatically move during a width adjustment and will always retain its correct position relative to the edge of the needle disc.

In order further to secure this position, the roller may have a radially projecting collar by which the roller is pressed resiliently and axially from outside against the edge of the associated needle disc. In this way the roller is always exactly positioned relative to the edge of the needle disc so that the needles always run cleanly through the peripheral grooves of the roller.

Another aspect of the present invention relates to the web of material running onto the first needle disc unit from the last guide roller in cases in which the latter is situated with its top apex at substantially the same height as the top apex of the first needle disc unit and in which the web of material is guided in a fixed system as far as the last guide roller. Typically, on the transition from the last guide roller to the first needle disc unit, there is, due to the geometry, a free fabric section which may be very undesirable.

The construction according to a further embodiment of the invention includes a deflecting roller disposed between the last guide roller and the first needle disc unit. The embodiment is intended to obviate the free fabric section by completely maintaining the fixed web guidance system until the web runs onto the first needle disc unit. In order to uniformly introduce the deflecting roller into the nip between the last guide roller and the first needle disc unit, a certain flexibility of the mounting of the deflecting roller is preferred.

In a further embodiment of the present invention, a fixed web guidance system is maintained as far as possible without any gaps, at the point where the web leaves the second needle disc unit. This may be achieved by a de-needling roller. The de-needling roller takes the web of material tangentially off the second needle disc unit. Due to the weight of the de-needling roller and the web tension, the de-needling roller bears on the first follower roller, the de-needling roller being freely vertically movable in a guide. The de-needling roller is positioned such that its periphery bears on the follower roller and is just beyond the reach of the needles of the second needle disc unit.

The guidance system may be adjustable horizontally, i.e., towards or away from the second needle disc unit, to thereby permit optimization of the position of the de-needling roller relative to the second needle disc unit.

According to a further aspect of the width stretching unit according to a possible embodiment of the invention, the width stretching of the web of material can be automated by connecting the pivoting drives for the first needle disc unit, which experience the web transverse tension, by using, for example, force sensors. Signals from the force sensors may be input to a control system which, by way of a drive en motor, controls the width adjustment of the second needle disc unit and hence also of the first needle disc unit.

A measuring device may be provided to measure the actual value of the set width of the second needle disc unit. The signal therefrom may be input to the control system.

A closed-loop control system can be associated with the open-loop control system to control the width setting of the second needle disc unit in such manner that the transverse tension of the web of material remains between a minimum and a maximum value, i.e., in a set range.

The web of material must not become limp in the transverse direction if the width stretching unit is to operate effectively. On the other hand, it should not be so strongly stretched transversely as to cause damage, particularly at the web selvedges. The maximum tension tolerated by a specific web of material is known from experiments. Thus, the control is such that as the web passes through the width stretching unit, the web is subjected to a predetermined transverse tension and in this way undergoes a constant structural change.

In order to avoid the second needle disc unit elements moving apart to the maximum width in the event of an unforeseen tearing or de-needling of the web selvedges, the control may be carried out to prevent uncontrolled widthwise movement of the second needle disc unit.

In order to counteract any longitudinal shrinkage such as occurs particularly in the case of mercerization, as well as to influence the web elongation in the transverse direction, it may be advantageous to combine the width stretching unit with a longitudinal stretching zone. In the case of a width-stretching unit having superposed needle disc units, the longitudinal stretching zone may advantageously precede the width stretching unit because then the longitudinal stretching zone may form the transition zone required to pass from the height of the upstream part of the plant to the apex height of the top needle disc unit.

All the features described may be used both individually and in any desired combination.

BRIEF DESCRIPTION OF THE DRAWINGS

Exemplified embodiments of the invention are illustrated in the drawings wherein:

FIG. 7 is an enlarged detail of FIG. 1 with a re-needling system.

FIG. 8 shows the re-needling system according to FIG. 7 from above.

FIG. 9 is a longitudinal section through the roller of the re-needling system to an enlarged scale.

DETAILED DESCRIPTION OF THE DRAWINGS

Figure 1:
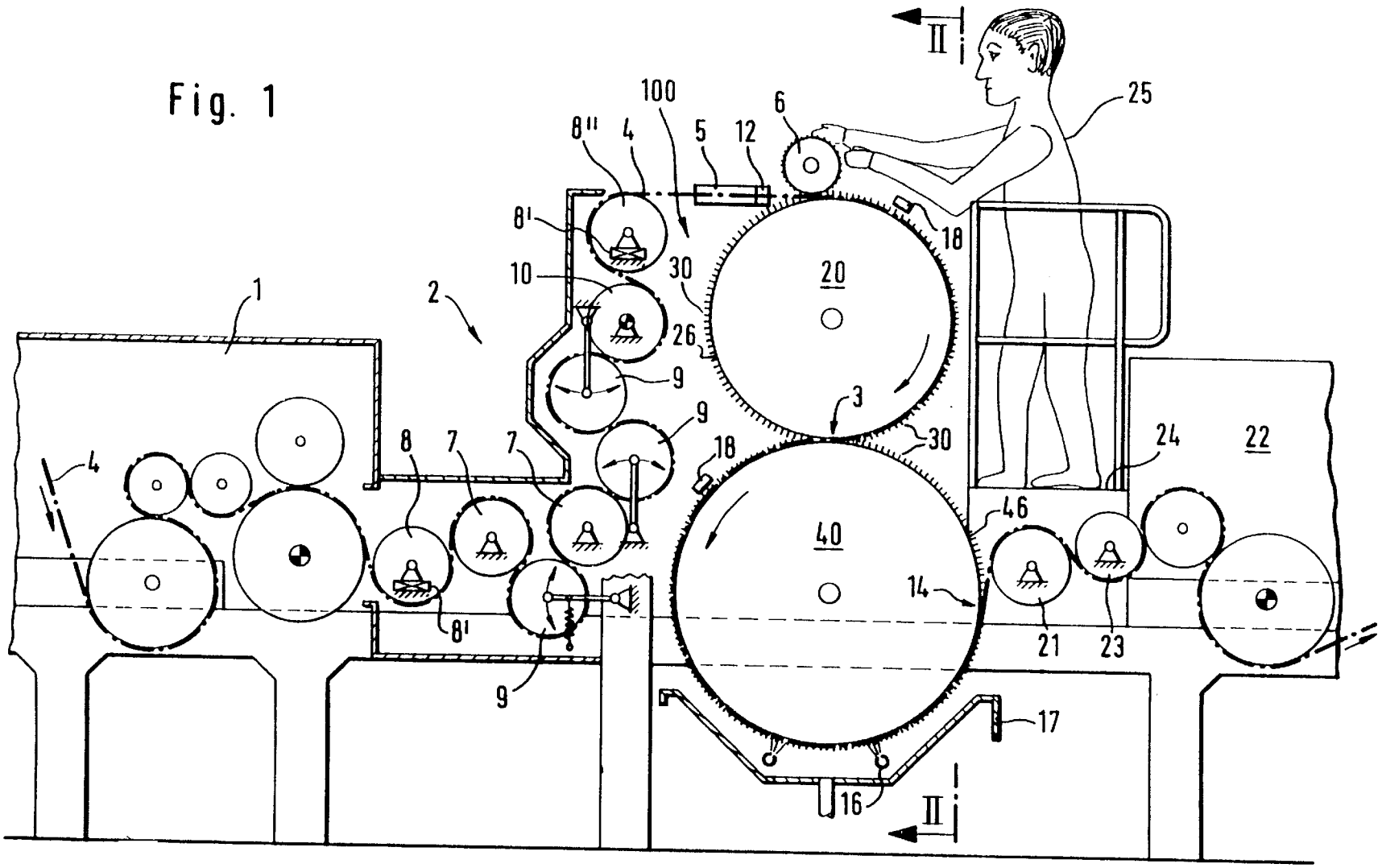
FIG. 1 is a diagrammatic side elevation of a width stretching unit incorporated in a continuous treatment plant.

The width-stretching unit having the general reference 100 in FIG. 1 is part of a mercerizing plant in the exemplified embodiment illustrated. The mercerizing plant comprises an upstream part in the form of a diffusion section 1, through which the web of material 4 passes after the mercerizing liquor has been applied. In the diffusion section 1 the mercerizing liquor has the opportunity of completely diffusing into the web of material 4.

All the rollers and needle discs referred to have parallel axes extending in the direction of the width of the material web 4.

Following the diffusion section 1 is a longitudinal stretching zone 2, in which the material web 4 is transferred from the height of the diffusion section 1, i.e., about half man height, to a greater height of about 2 meters in a fixed material guidance system. The longitudinal stretching zone 2 comprises fixed guide rollers 7, guide rollers 8 and 8" mounted in tension sensors 8', floating guide rollers 9, and a driven traction roller 10. By way of the drive for the latter it is possible to stretch the material web 4 longitudinally before the width stretching operation and to control the longitudinal tension occurring in these conditions in the web 4 by means of the preceding roller 8 with the tension sensors 8'. The two guide rollers 8, 8" do not bear against their neighboring rollers, but can shift slightly under the pull of the web 4 to permit measurement in the tension sensors 8'. The sequence of the rollers 8, 7, 9, 7, 9, 9, 10, 8" making up the longitudinal stretching zone 2 extends upwards, i.e., the subsequent rollers of the sequence have their axes at an increasingly higher level so that a difference in height can be overcome.

From the top guide roller 8" as the last roller in the sequence the web of material 4 extends substantially horizontally from the longitudinal stretching zone 2 into the width stretching unit 100. This comprises a first needle disc unit 20, which is at the top in the exemplified embodiment, and a second needle disc unit 40 disposed vertically therebeneath. The web of material 4 runs onto the top needle disc unit 20 in the region of its top apex, extends around the top needle disc unit 20 through about 180°, and is transferred at point 3 to the bottom needle disc unit 40. The web 4 passes around the bottom needle disc unit 40 through about 270° and leaves the bottom needle disc unit 40 at point 14. The web 4 is taken out of the needles 30 by a guide roller 21 and is transferred by another guide roller 23 to the following or downstream part of the machine, which in this exemplified embodiment is the stabilizing section 22 of the mercerizing machine.

An operator's station 24 extending across the width of the web of material is disposed above the substantially horizontal guide zone formed by the guide rollers 21, 23. From the operator's station 24, an operator 25 can follow the correct entry of the web 4 onto the first needle disc unit 20.

In order to ensure reliable attachment of the edges of the web 4 onto the first needle disc unit 20, a mechanical selvedge straightener 5 is provided on each side of the first needle disc unit 20 immediately before the point of entry of the web, and biasing brush rollers 6 are provided above the two needle discs of the first needle disc unit 20 to press the edges of the web of material into the needles 30 of the first needle disc unit 20. The presence of the selvedge in the region of the selvedge straightener 5 is detected by an electronic selvedge detector 12, and correct pinning of the material, i.e., the presence of the selvedge in the region of the needle discs, is detected by corresponding sensors 18.

The actual width stretching of the fabric is effected by the first needle disc unit 20, while the bottom needle disc unit 40 maintains the width of the fabric during its travel over the 270°. In this exemplified embodiment, an application system for treatment liquid in the form of a pair of spray tubes 16 is disposed beneath the bottom needle disc unit 40. The spray tubes 16 spray water or highly diluted liquor radially from outside against the web 4 in order to initiate stabilization at this stage. Surplus treatment liquid is discharged via a trough 17 disposed beneath the bottom needle disc unit 40.

Figure 2:
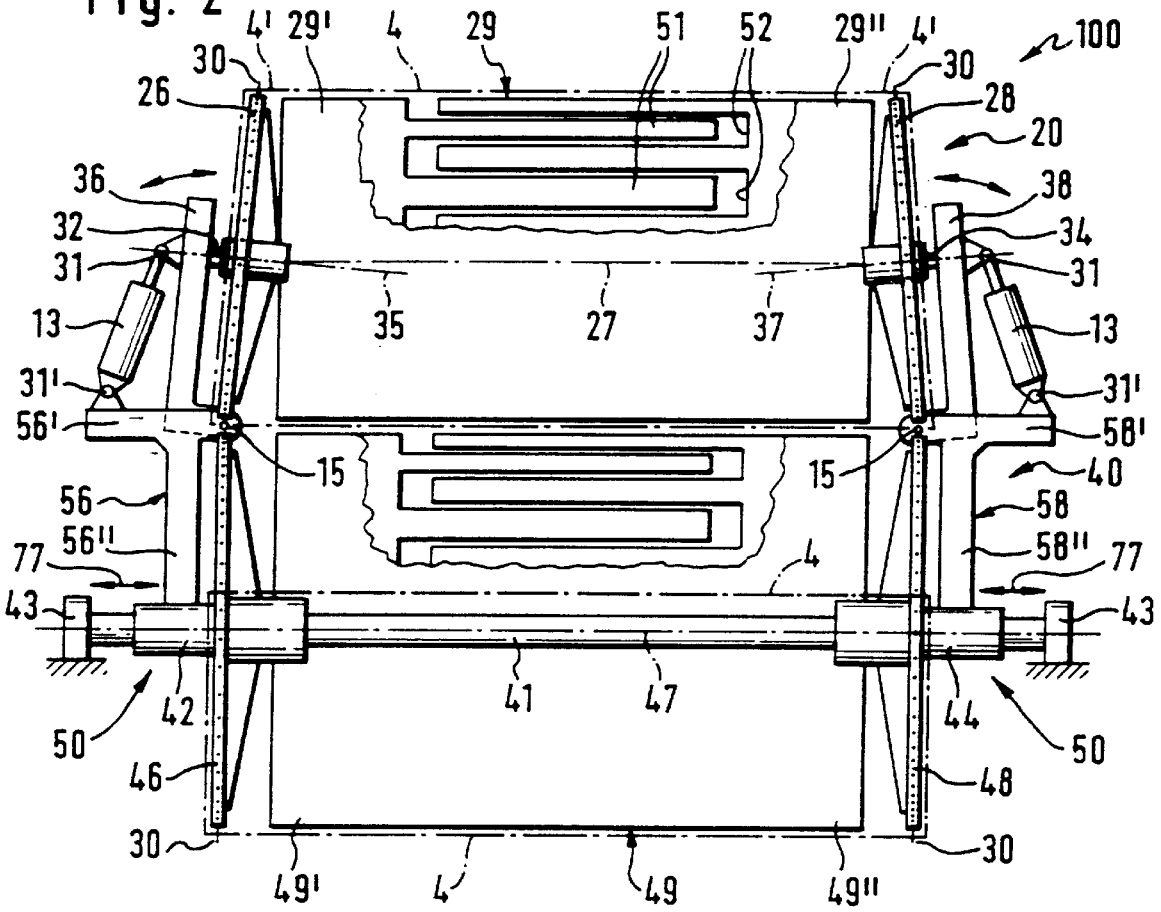
FIG. 2 is a diagrammatic elevation in the direction of arrows II—II of FIG. 1, with the operator's station omitted.

FIG. 2 shows the construction of the two needle disc units 20 and 40 in greater detail.

The first needle disc unit 20 in the direction of travel of the web 4, i.e. the top unit 20 in this exemplified embodiment, comprises two needle discs 26, 28 of a diameter of about 800 mm. The two needle discs 26, 28 are disposed in the region of the selvedges 4' of a web of a material 4 along and substantially perpendicular to a first axis 27. The discs 26, 28 have at their periphery closely set radial needles 30 which project freely radially about 10 to 15 mm. In use, the radial needles 30 penetrate the selvedges 4' of the web of material 4 and hold the same fast axially. The needle discs 26, 28 are mounted for rotation about axes 35, 37 on journals 32, 34 directed substantially towards one another. The journals 32, 34 are secured at the respective top ends of substantially upright pivoting elements 36,38. The upright pivoting elements 36,38 are pivotable about pivot axes 15 which are perpendicular to the plane passing through the axis 27 of the top needle disc unit 20 and the axis 47 of the bottom needle disc unit 40 and which extend tangentially to the needle discs 26, 28. Thus, on a pivoting movement of the associated pivoting elements 36,38, the edges of the needle discs 26, 28 at their bottom apices remain in the region of the pivot axes 15. Also, on a pivoting movement of the pivoting elements 36, 38, the axes of rotation 35, 37 of the two needle discs 26, 28 shift as indicated from a position of alignment to an oblique position as shown in FIG. 2. The pivoting movement is produced by pivoting drives 13 each constructed as a linear drive, e.g., as a spindle or as a piston and cylinder unit. Each pivoting drive 13 engages a point of engagement 31 on the outside of the pivoting elements 36, 38 in the region of the axes 35, 37 at one end. At the other end, the pivoting drive 13 engages a point of engagement 31' on substantially upright support elements 56, 58.

The pivot axis 15 is formed by a bearing at the pair of substantially upright support elements 56, 58 associated with the bottom needle disc unit 40. In the elevation shown in FIG. 2, the support elements 56, 58 are substantially T-shaped and have cross-bars 56', 58', respectively, which are substantially parallel to the axis 47 of the bottom needle disc unit 40. At the inner free ends of the cross-bars 56', 58' are disposed the bearings with the pivot axes 15. At the outer free ends are disposed the other point of engagement 31' for the associated pivoting drive 13. Thus, on each side of the top needle disc unit 20, the pivoting drive 13 is disposed outside the pivoting element 36, 38 and is able to pivot the same in the direction of the arrow, so that the inclination of the needle discs 26, 28 is variable. The support elements 56, 58 have webs 56", 5" disposed substantially perpendicular to the cross-bars 56', 58'. The webs 56", 58" are, at the bottom, each welded to a hub 42, 44 respectively disposed on a shaft 41 having the axis 47. The shaft 41 is mounted in brackets 43 in the machine frame.

On the inside of the hubs 42, 44, the two bottom needle discs 46, 48 of the second needle disc unit 40 are mounted rotatably on the shaft 41 and have a diameter of about 1000 mm in the exemplified embodiment. They are so positioned in the axial direction that each outer edge with the needles 30 is situated in the same transverse plane of the axis 47 as the respective pivot axis 15. In the region of the pivot axis 15 the peripheries of the needle discs 26 and 46, 28 and 48, respectively, are situated directly opposite one another with a slight spacing 55. The spacing 55 is only slightly in excess of the length of the needles 30. The situation does not change when the needle discs 26, 28 are changed in respect of their inclination.

The hubs 42, 44 and with them the needle discs 46, 48 are displaceable along the shaft 41 in the direction of the arrows 77 for adjustment of the axial position of the needle discs 46, 48 to the web width. In the event of such displacement, the support elements 56, 58 and 36, 38 are also entrained and shift jointly with the same. Thus the mutual position of the needle discs 26 and 46, 28 and 48 is maintained in the region of the pivot axes 15 even in the event of displacement of the needle discs 46, 48.

The pivoting element 36 and the support element 56, on the one hand, and the pivoting element 38 and the support element 58, on the other hand, respectively form a support 50 which constitutes a self-contained assembly, is adjustable in the axial direction, carries both needle discs of one side, and, in the event of an adjustment, entrains the two needle discs jointly while maintaining their same axial position or their direct opposite position in the region of the pivot axis.

When the web of material 4 runs onto the top of the first needle disc unit 20 and passes round the same through 180° in the downward direction with reference to FIG. 2, it is stretched in the direction of the width because the needles 30 engaging the selvedges 4' of the web of material 4 move axially away from one another. A flexible fabric, such as a textile web, has the tendency to constrict under such transverse tension during a partly cylindrical path, so that the "diameter" at the center becomes less than at the edges. To obviate this phenomenon, the two needle disc units 20, 40 comprise support drums 29, 49 between the top needle discs 26, 28, and the bottom needle discs 46, 48, respectively. The support drums 29, 49 rotate with their respective needle discs 26, 28; 46, 48. In the exemplified embodiment, the support drums 29, 49 each consist of two identical cylindrical halves 29', 29"; 49', 49", the diameter of which is equal to the diameter of the respectively associated needle discs 26, 28; 46, 48. The halves 29', 29" and 49', 49" are disposed coaxially on the axes 27, 47 respectively and rotate with the needle discs 26, 28; 46, 48. At the facing sides, the halves 29', 29" are divided up into peripherally uniformly distributed axis-parallel narrow finger-like segments 51, between which are axis-parallel recesses 52 of a width somewhat in excess of the width of the segments 51. Thus, the facing ends of the segments 29', 29" can be pushed axially inside one another and also shifted axially relative to one another as shown in FIG. 2, without the support of the web of material unduly suffering as a result in the middle zone. On an axial displacement of the supports 50 in the direction of the arrow 77, the halves 29', 29"; 49', 49" are entrained so that the length of the support drums 29, 49 which substantially fill the gap between the needle discs 26, 28; 46, 48, in the axial direction, is automatically adjusted.

Figure 3:
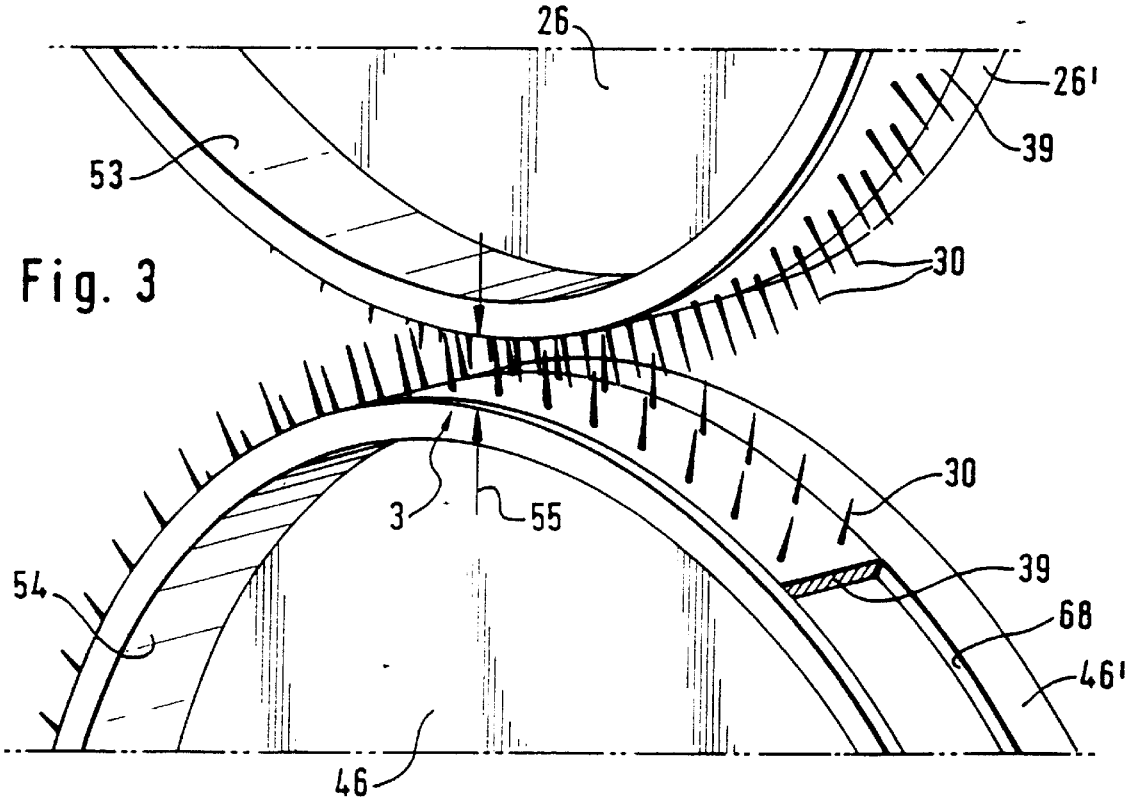
FIG. 3 is a perspective elevation of the mutual engagement of the needles of cooperating needle discs.

FIG. 3 shows in detail the engagement zone of the associated needle discs by reference to the example of the needle discs 26, 46. The needle discs 26, 46 have axially projecting collars 53, 54 at the edges. The collars 53, 54 are of rectangular cross-section and form the peripheral edges 26', 46' of the needle discs 26, 46 respectively. A strip 39 containing the needles 30 is disposed in a peripheral groove 68 of the edge 46' and fills the same. The same applies to the peripheral surface 26'. The needles 30 are in each case provided in two adjacent planes perpendicular to the axis of the associated needle disc 26, 46. At their closest narrowest point, the peripheral surfaces 26', 46' are separated by the space 55. Since the needles 30 are offset from one another in the axial direction, the needles 30 on the two sides can penetrate relative to one another without touching one another or resting on the opposite collar 53 or 54. FIG. 3 shows the situation without the web of material. When the web of material is in the apparatus, it passes from the top needle disc 26 to the bottom needle disc 46 when they are at their closest point, that is, when they are separated by the space 55. This point is the transfer point 3 shown in FIG. 1. In the region of this point 3, the web is engaged both by the needles 30 of the top needle disc 26 and by the needles 30 of the bottom needle disc 46. The needles 30 of the top needle disc 26 then lift out of the web as it continues to rotate and at that moment the web has already been pinned onto the needles 30 of the bottom needle disc 46. Thus, the transition to the needle disc 46 occurs without any intermediate release or loosening of the engagement of the web 4 at its edge.

The needle discs 26, 46 and 28, 48 are peripherally coupled by the web of material and thus automatically rotate at the same peripheral speed corresponding to the web speed. There is no need to apply a drive mechanism to the needle discs 26, 46; 28, 48 because they, like the support drums 29, 49, are driven by the web 4.

Figure 4:
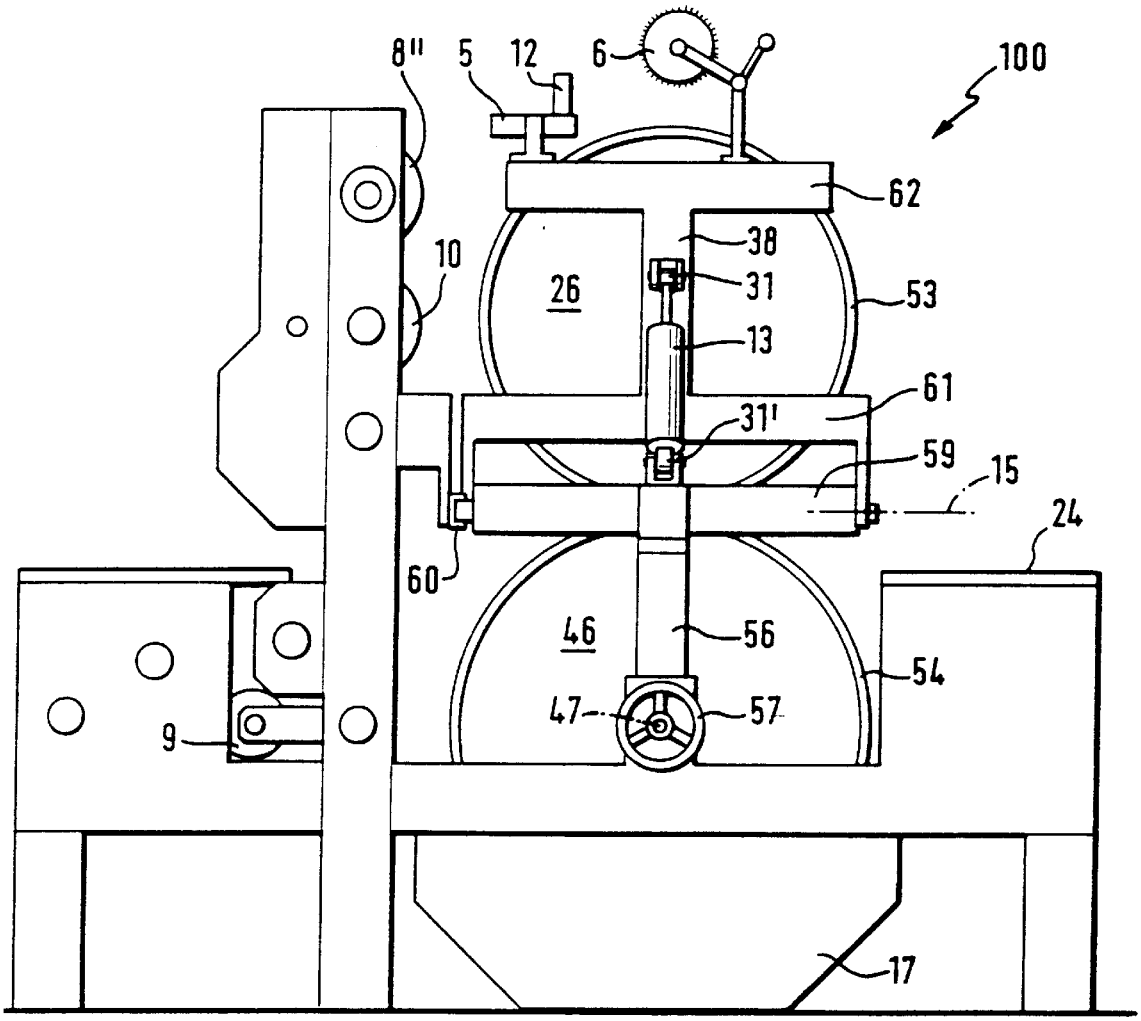
FIG. 4 is a side elevation of the width stretching unit.
Figure 5:
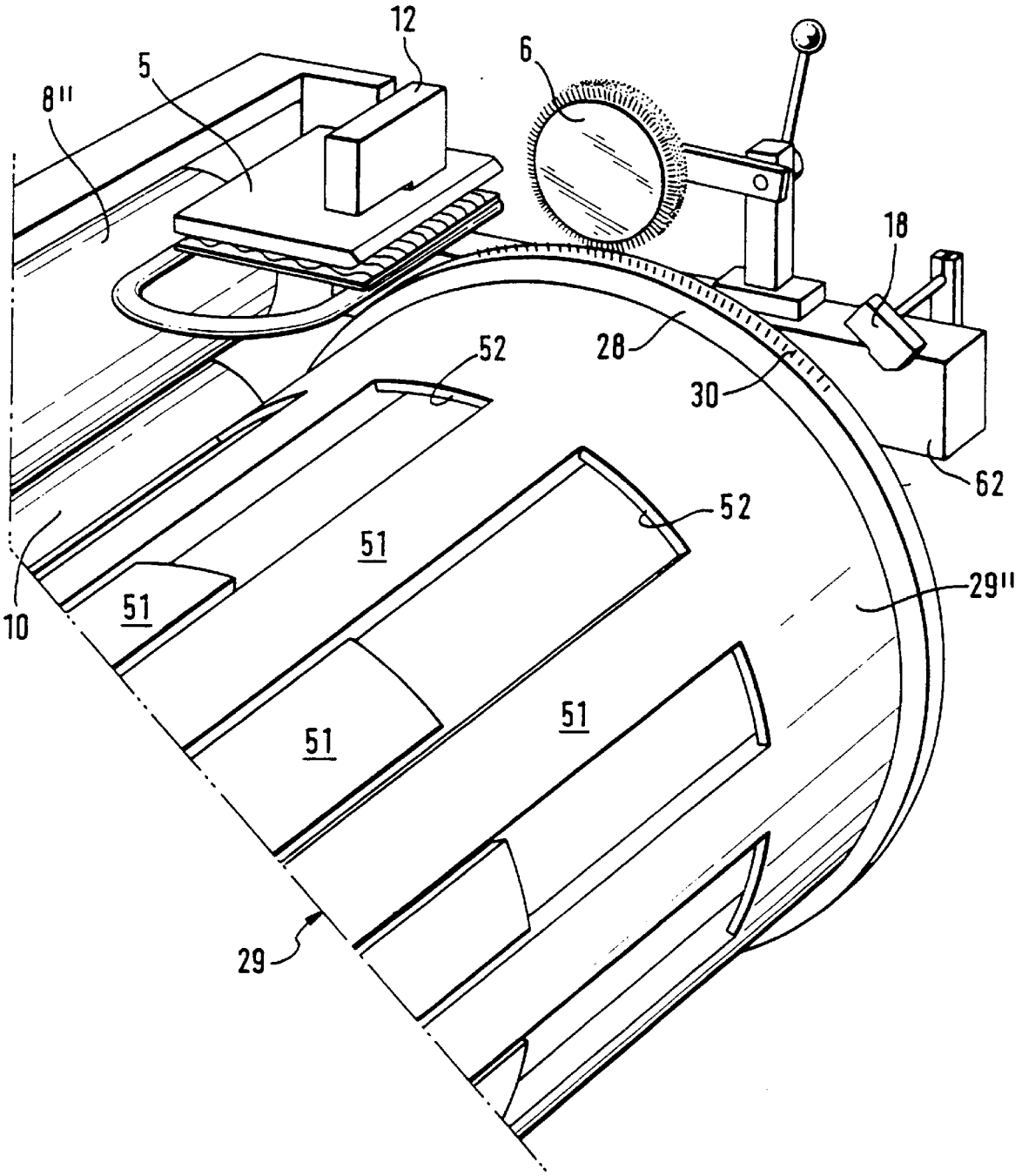
FIG. 5 is a perspective detail elevation of the zone in which the web runs onto the needle disc units.

FIG. 4 is a side elevation showing a specific embodiment of the width stretching unit 100. A handwheel 57 is rotatable on a spindle 47 and adjusts the supports 50 along the shaft 41 in the direction of the arrow 77 (as shown in FIG. 2). Instead of the manual adjustment, a motor adjustment may be provided. At its end, the support element 56 has a transverse element 59 which is engaged by a guide 60. The guide 60 is fixed to the frame and prevents the support 50 from tipping about the shaft 41. The pivoting element 38 has a transverse element 61 at the bottom end, extending substantially parallel to and above the transverse element 59 and being pivotable thereon about the pivot axis 15. A transverse element 62 is also provided at the top end of the pivoting element 36. The selvedge straightener 5, biasing brush roller 6, and sensor 12 are disposed on the transverse element 62 as shown in detail in FIG. 5.

Figure 6:
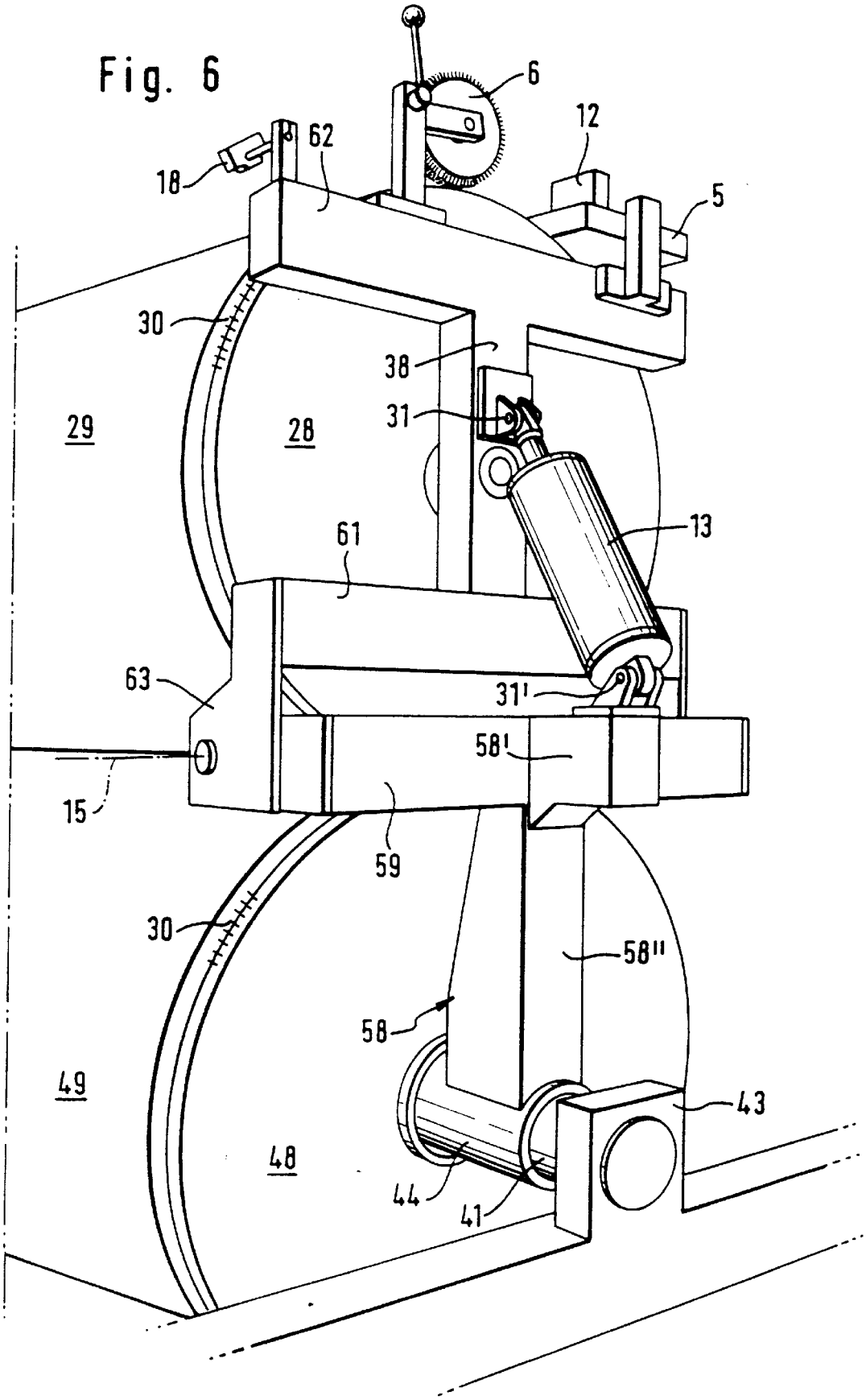
FIG. 6 is a perspective side elevation of the width stretching unit from the opposite side with respect to FIG. 4.

FIG. 6 is a perspective view from the side opposite that shown in FIG. 4. The reference numerals are the same. As shown, the bottom transverse element 61 of the pivoting element 38 has downwardly extending bearing flanges 63. The bearing flanges 63 may pivot on the pivot axis 15, which extends in the region of the transverse element 59 of the support element 58.

FIGS. 7 to 9 show a re-needling unit having the general reference 90. A re-needling unit 90 is associated with each web selvedge 4'. Only the device 90 associated with the front selvedge according to FIG. 1 and with the left-hand selvedge according to FIG. 2 will be described. The re-needling unit 90 is disposed on a support 91 rigidly connected to the support element 56 and with the movements of which it thus participates in the transverse direction of the fabric direction.

A pivot axis 92 parallel to the axis of the needle disc 46 is provided on the support 91. A bell-crank lever 93 is mounted pivotally on the pivot-axis 92. A downwardly extending arm 93' is loaded in the clockwise direction with reference to FIG. 7 by, for example, a spring 94 which is adjustable by screw 95.

Considered in the direction of rotation of the needle disc 46, the pivot axis 92 is disposed closely above the needle disc 46 at a distance from the central plane M that joins the axes of the needle discs 26, 46. The second arm 93" of the bell-crank lever 93 points towards the gap between the needle discs 26, 46. At its free end, the second arm 93" carries a roller 96 which is freely rotatable about an axis parallel to the axis of the needle disc 46 and of the second needle disc unit 40. The roller 96 rolls on the edge 46' of the needle disc 46, the roller 96 being pressed on the edge 46' by the action of the spring 94. The needle strip 39 containing the radially projecting needles disposed in two planes perpendicular to the axis of the needle disc 46 is recessed into the edge 46'. The roller 96 is substantially cylindrical in the region of the width of the edge 46' and has two peripheral grooves 97 in the region of the needles 30. The grooves completely accommodate the needles 30 in the manner shown in FIG. 9. The action of the spring 94 presses the roller 96 onto the edge 46'. The selvedge 4' of the web 4 therebetween is pressed onto the needles 30 and is thus reliably pinned. In its cylindrical part, the roller 96 has a relatively small diameter of about 60 mm and is peripherally disposed as closely as possible to the gap between the needle discs 26, 46 so that the distance between complete pinning and the transfer point 3 is as small as possible.

At its axial outer end, the roller 96 has a peripheral collar 98 with a side surface 98' perpendicular to the axis of the roller 96. Roller 96 is axially slidable on its shaft 99 and is pressed by the side surface 98' of the collar 98 against the outer end face 46" of the edge 46' of the needle disc 46 by a helical compression spring 70 surrounding the shaft 99. The correct mutual position of the needles 30 and peripheral grooves 97 is thus ensured.

Figure 10:
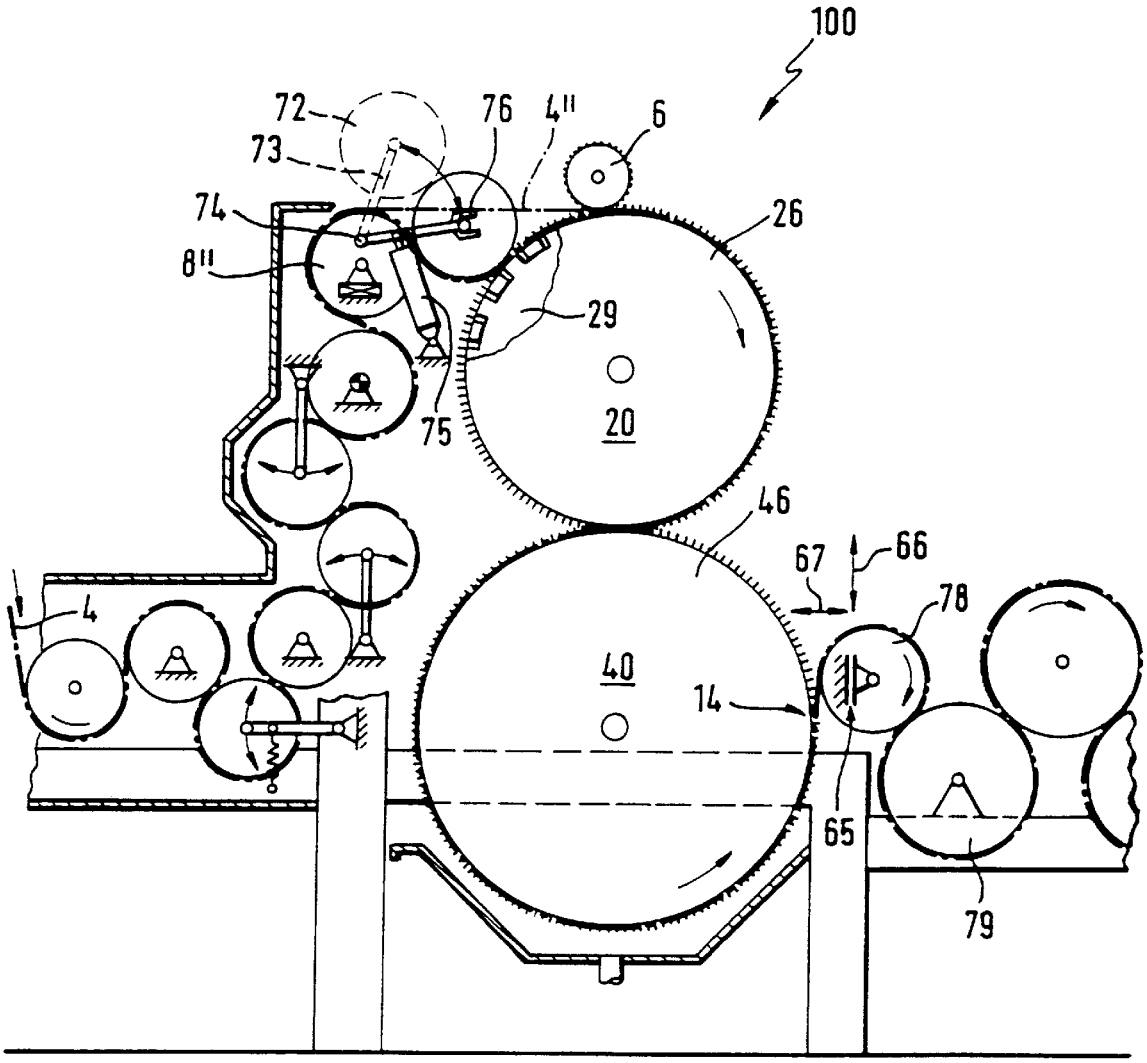
FIG. 10 is a partial elevation, corresponding to FIG. 1, of an embodiment which is modified at the width stretching unit inlet and outlet.

FIG. 10 shows a deflecting roller 72 disposed in the region of the entry of the web 4 to the first needle disc unit 20 and adapted to avoid the free path of the web 4 visible in FIG. 1 and denoted by reference 4" in FIG. 10. Up to the top apex of the last guide roller 8", the web of material runs in a fixed or substantially fixed guide system. To avoid the free zone 4", a deflecting roller 72 is mounted on links 73 for pivoting about an axis 74 that is disposed in the region of the top half of the last guide roller 8". The deflecting roller 72 may be pivoted by a linear drive 75, which engages the link 73, for example, from the broken-line position above the zone 4" to the solid-line position. In the solid-line position, the web 4 wraps around the bottom part of the deflecting roller 72 which bears against both the last guide roller 8" and against the first needle disc unit 20 or its support drum 29 (between the needles 30). In this way, the fixed guidance of the material is ensured over the section between the last guide roller 8" and the first needle disc unit 20.

The mounting of the deflecting roller 72 at the end of the link 73 is substantially resilient so that the deflecting roller 72 may seek a correct position of uniform abutment against both the guide roller 8" and the support drum 29. This is shown diagrammatically by the forked construction 76 at the end of the links 73 in FIG. 10.

In the embodiment illustrated, the deflecting roller 72 and the last guide roller 8" have substantially the same diameter, while the support drum 29 has approximately three times that diameter.

At the needle disengagement point 14, at which point the web of material 4 extends substantially vertically upwards, according to the example illustrated, a special needle disengaging or de-needling roller 78 is provided to ensure that the web is satisfactorily disengaged from the needles of the second unit 40. The de-needling roller 78 is on the bottom right in FIG. 10 and is mounted for free movement in a vertical guide 65. After being detached from the needles 30 of the second needle disc unit 40, the web of material 4 wraps round the top half of the de-needling roller 78 and then passes to a follower roller 79 in a fixed guidance system. The de-needling roller 78 bears from above against the follower roller 79. The de-needling roller 78 is mounted to be freely movable in the guide 65 in the direction of the arrows 66 and seeks its position in the vertical direction by its own weight and the longitudinal tension in the web of material. To be able to optimize the position of the de-needling roller 78 on contact with the follower roller 79 relative to the needles 30 of the second needle disc unit 40 for the de-needling operation, the guide 65 can be adjusted horizontally in the direction of arrow 67. This adjustment, however, is self-locking, i.e., the de-needling roller 78 cannot freely shift horizontally.

In the exemplified embodiment illustrated, the de-needling point 14 is situated somewhat above the axis of the second needle disc unit 40. The de-needling roller 78 has a diameter corresponding substantially to the diameter of the rollers 8" and 72. The de-needling roller 78 is so positioned by suitable displacement of the guide 65 in the direction of arrow 67 so that the de-needling roller 78 is just out of touch with the needles 30 of the second needle disc unit 40.

Figure 11:
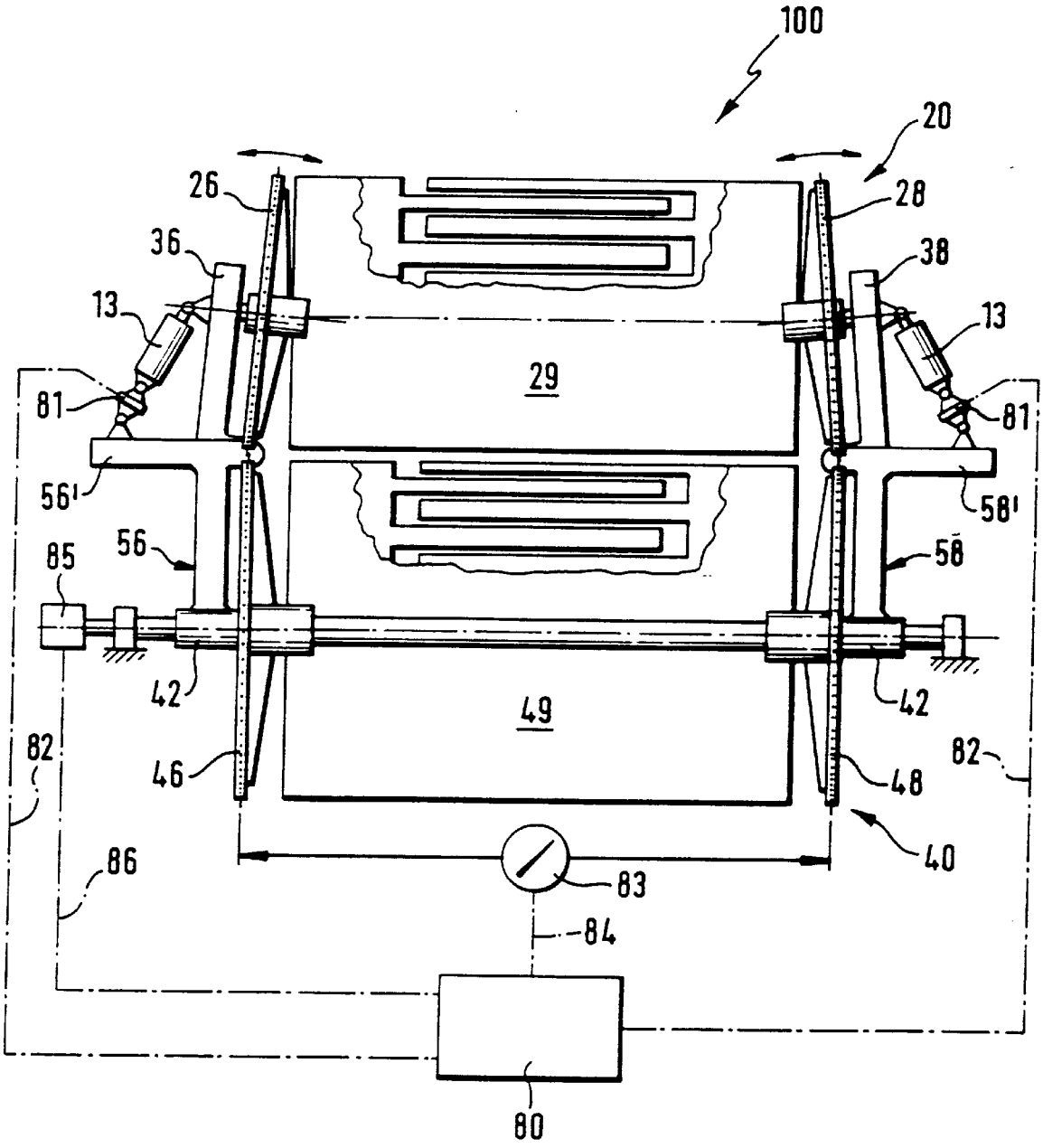
FIG. 11 is an elevation, corresponding to FIG. 2, of an embodiment with automation elements.

FIG. 11 shows a possibility for automating the operation of the width stretching unit 100. An open-loop and closed-loop control system 80 is provided. The pivoting drives 13 of the first needle disc unit experience the transverse tensile stress of the web of material. They engage the respective arms 56', 58' of the support elements 56, 58 via force measuring elements 81, the signals of which are fed via lines 82 to the open-loop and closed-loop control system 80. The width adjustment of the second needle disc unit 40 and hence also of the first needle disc unit 20 is effected by a motor 85, which is controlled by the control system 80 via a line 86. To detect the actual value of the width adjustment of the second needle disc unit 40, a measuring device 83 can be provided whose signal can be sent to the control system 80 via a line 84.

The control can be such that the transverse tension is set to a specific value between a minimum and a maximum, which is governed by the transverse tearing strength of the web and has been ascertained experimentally beforehand. A web of material treated in this way therefore always has the same transverse tension and has experienced the accompanying structural change.

Alternatively, the control system 80 may be such that a specific required web width is preset. This width is maintained independently of the tension required for the purpose. If, however, the minimum value or, in particular, the maximum value of the transverse tension is exceeded, a corresponding signal is transmitted or the unit switched off.

It is claimed:

1. A width stretching unit for a web of material, the width stretching unit comprising:

a first needle disc unit having first and second needle discs disposed along a first axis at an axial distance corresponding to a width of the web of material, the first and second needle discs having a multiplicity of peripherally distributed needles pointing radially outward, the multiplicity of needles intended for insertion into selvedges of the web of material;

a pivoting mechanism for pivoting a first rotational axis and a second rotational axis of the first and second needle discs, respectively;

a pinning mechanism for pinning the web of material by its edges onto the multiplicity of needles of the first and second needle discs in a region of reduced axial distance between edges of the first and second needle discs;

a second needle disc unit associated with the first needle disc unit, the second needle disc unit having a second axis parallel to the first axis, the second needle disc unit further having third and fourth needle discs rotatably mounted substantially perpendicular to the second axis, the third and fourth needle discs rotating about the second axis at the same peripheral speed as the first and second needle discs, an axial distance between the third and fourth needle discs being equal to the axial distance between the first and second needle discs in a zone of increased distance between the first and second needle discs;

wherein the edge of the first needle disc practically touches the edge of the third needle disc in the zone of increased distance, and the edge of the second needle disc practically touches the edge of the fourth needle disc in the zone of increased distance so that it is possible for the web of material to be transferred from the first and second needle discs to the third and fourth needle discs, respectively, without relinquishing the pinning on at least one of the first or third needle discs and at least one of the second or fourth needle discs.

2. A width stretching unit according to claim 1, wherein the first and third needle discs are jointly adjustable in the direction of the width of the web relative to the second and fourth needle discs.

3. A width stretching unit according to claim 2, wherein the first and third needle discs have a first common support and the second and fourth needle discs have a second common support, the first and second common supports being adjustable relative to one another on the second axis.

4. A width stretching unit according to claim 3, wherein the first and second common supports each comprise a first support element having a fixed angle relative to the second axis, a second support element for the first and second rotational axes of the first and second needle discs, respectively, the second support element being pivotable on the first support element by a pivoting drive about a pivot axis, the pivot axis being in a plane substantially perpendicular to the second axis, extending perpendicularly to a plane joining the first axis and the second axis, and being tangential to the first and third needle discs and to the second and fourth needle discs, respectively.

5. A width stretching unit according to claim 4, wherein the first support element has a radial arm substantially radial to the second axis and an axis-parallel arm substantially parallel to the second axis, the radial arm having a foot, wherein the first support element is bent and is fixed by the foot of the radial arm on a hub mounted on the second axis, and the axis-parallel arm carries the pivot axis at its free end.

6. A width stretching unit according to claim 5, wherein the first support element has a T-shaped construction in the plane perpendicular to the plane joining the first axis and the second axis, a web being one arm of the T-shaped construction and a cross-bar substantially parallel to the first and second axis being another arm of the T-shaped construction, the cross-bar carrying the pivot axis at an inner free end and carrying a first point of engagement of the pivoting drive at an outer free end.

7. A width stretching unit according to claim 4, wherein the second support element has a first end pivotably mounted on the first support element so as to pivot about the pivot axis, and has a second end on which, respectively, the first and second rotational axes of the first and second needle discs are disposed.

8. A width stretching unit according claim 4, wherein the pivoting drive is a linear drive which, as considered in the axial direction of the first needle disc unit, is disposed axially outside the second support element, and engages a second point of engagement near a free end of the second support element.

9. A width stretching unit according to claim 1 further comprising at least one support drum for the web of material, the at least one support drum disposed between the first and second needle discs or between the third and fourth needle discs, the at least one support drum practically filling the gap axially between the first and second needle discs or between the third and fourth needle discs, and having approximately the same diameter as the first and second needle discs or the third and fourth needle discs.

10. A width stretching unit according to claim 9, wherein a length of the at least one support drum is adjustable.

11. A width stretching unit according to claim 10 wherein the at least one support drum consists of coaxial cylindrical first and second parts having approximately the same diameter, a periphery of the first and second parts being formed by freely projecting finger-like segments, the segments having free corresponding gaps therebetween in the peripheral direction of a width of the segments, the segments of the first part engaging gaps of the second part, the first and second parts being axially displacable relative to each other.

12. A width stretching unit according to claim 1 wherein the first needle disc unit is disposed above the second needle disc unit and the web of material is guided so as to run onto the first needle disc unit substantially horizontally in the region of a top apex line of the first needle disc unit.

13. A width stretching unit according to claim 12, further comprising an operator's station extending across the web of material above the web of material on a downstream side of the second needle disc unit.

14. A width stretching unit according to claim 1 further comprising an application system for applying a treatment liquid to the web of material, the application system disposed in zones of the second needle disc unit around which the web of material is wrapped.

15. A width stretching unit according to claim 1 further comprising selvedge straighteners disposed at both edges of the web of material just before the entry of the web of material onto the first needle disc unit.

16. A width stretching unit according to claim 1 further comprising a re-needling system disposed at each selvedge of the web of material after a point of transfer of the web of material from the first needle disc unit to the second needle disc unit as considered in the direction of travel of the web of material, the re-needling system exerting a pressure radially from outside onto the selvedge of the web of material to promote penetration of the multiplicity of needles of the second needle disc unit into the selvedge of the web of material.

17. A width stretching unit according to claim 16, wherein the re-needling system at each selvedge of the web of material comprises a roller pressed resiliently from outside onto the selvedge of the web of material or onto the peripheral edge of the third or fourth needle disc, the roller being rotatable about an axis parallel to the second axis of the second needle disc unit and having at least one peripheral groove for the passage of the multiplicity of needles.

18. A width stretching unit according to claim 17, wherein the roller is mounted on the first support element.

19. A width stretching unit according to claim 17 wherein the roller at each selvedge has a radially protecting collar by which the roller may be pressed resiliently axially from outside against an end face of the peripheral edge of the third or fourth needle disc, respectively.

20. A width stretching unit according to claim 12, further comprising a last guide roller and a deflecting roller, the last guide roller disposed with its top apex situated approximately at the same height as the top apex of the first needle disc unit and before the web of material runs onto the first needle disc unit, the last guide roller being followed by the deflecting roller disposed on links that pivot about a link axis situated approximately at the height of the top half of the guide roller, a diameter of the deflecting roller being larger than a clearance between the guide roller and the first needle disc unit, the deflecting roller being pivotable from a top position above the web of material extending from the apex of the guide roller to the apex of the first needle disc unit to a bottom position in which the deflecting roller contacts both the guide roller and the support drum of the first needle disc unit between the multiplicity of needles on each edge of the first needle disc unit and the deflecting roller being partially wrapped in its bottom zone by the web of material.

21. A width stretching unit according to claim 20, wherein a rotational axis of the deflecting roller is slightly shiftable at the links.

22. A width stretching unit according to claim 12, further comprising a de-needling roller disposed at an outlet of the web of material from the second needle disc unit, a diameter of the de-needling roller being larger than a clearance between the second needle disc unit and a follower roller disposed downstream of the de-needling roller, the de-needling roller being vertically guided for free movement on a vertical guide in such manner that the de-needling roller rests on the follower roller and just beyond the touch of the multiplicity of needles of the second needle disc unit.

23. A width stretching unit according to claim 22, wherein the vertical guide is adjustable in the horizontal direction.

24. A width stretching unit according to claim 4 wherein the pivoting drives are connected to the first support elements via force sensors that produce signals, the signals being input to a control system which controls a drive motor, the drive motor controlling the width adjustment of the second needle disc unit.

25. A width stretching unit according to claim 24, further comprising a measuring device for measuring the actual value of the set width of the second needle disc unit, a signal of the measuring device being input to the control system.

26. A width stretching unit according to claim 24 wherein the control system controls the width adjustment of the second needle disc unit so that a transverse tension in the web of material remains between a minimum and a maximum value.

27. A width stretching unit according to claim 26 wherein, in the event of a sudden drop in the transverse tension in the web of material in a case of the web selvedges tearing or disengaging from the needles, uncontrolled width-wise movement of the second needle disc unit is prevented.

28. A width stretching unit according to claim 1 further comprising a longitudinal stretching zone.

29. A width stretching unit according to claim 28, wherein the longitudinal stretching zone precedes a width stretching zone.

* * * * *

UNITED STATES PATENT AND TRADEMARK OFFICE

CERTIFICATE OF CORRECTION

PATENT No. : 5,819,382

DATED : October 13, 1998

INVENTOR(S): Steffen GREIF, Peter PFEIFFER and Ingo LISON

It is certified that error appears in the above-identified patent and that said Letters Patent is hereby corrected as shown below:

Column 5, line 3, after "drive" delete "en".

Column 7, line 63, after "56"," change "5"" to "58"".

Signed and Sealed this

Seventeenth Day of August, 1999

*Attest:*

Q. TODD DICKINSON

*Attesting Officer*

*Acting Commissioner of Patents and Trademarks*